US007328553B2

(12) United States Patent
Spatafora

(10) Patent No.: US 7,328,553 B2
(45) Date of Patent: Feb. 12, 2008

(54) UNIT FOR OVERWRAPPING PRODUCTS, IN PARTICULAR PACKETS, AND A RELATIVE OVERWRAPPING METHOD

(75) Inventor: Mario Spatafora, Granarolo (IT)

(73) Assignee: G.D S.p.A., Bologna (IT)

( * ) Notice: Subject to any disclaimer, the term of this patent is extended or adjusted under 35 U.S.C. 154(b) by 22 days.

(21) Appl. No.: 11/231,778

(22) Filed: Sep. 22, 2005

(65) Prior Publication Data

US 2006/0064944 A1 Mar. 30, 2006

(30) Foreign Application Priority Data

Sep. 27, 2004 (IT) ..... BO2004A0598

(51) Int. Cl.
*B65B 11/00* (2006.01)
*B65B 19/22* (2006.01)

(52) U.S. Cl. ..... 53/465; 53/210

(58) Field of Classification Search ..... 53/465, 53/466, 210, 230–234; *B65B 11/30, 11/32, B65B 19/22*

See application file for complete search history.

(56) References Cited

U.S. PATENT DOCUMENTS 3,543,471 A * 12/1970 Youngman ..... 53/466
5,301,489 A * 4/1994 Benedetti ..... 53/234
5,305,580 A * 4/1994 Draghetti ..... 53/465
6,324,817 B1 * 12/2001 Ghini et al. ..... 53/466
6,470,651 B1 10/2002 Polazzi
6,643,996 B2 11/2003 Spatafora
2002/0189207 A1 12/2002 Spatafora
2003/0205025 A1 11/2003 Spatafora

FOREIGN PATENT DOCUMENTS

EP 1052171 A 11/2000
EP 1260442 A2 11/2002
EP 1361158 A2 11/2003
EP 1260442 11/2004
GB 2010769 A 7/1979
WO WO 00/47474 * 8/2000

* cited by examiner

*Primary Examiner*—Stephen F. Gerrity
(74) *Attorney, Agent, or Firm*—Timothy J. Klima

(57) ABSTRACT

Packets of cigarettes with a predominating longitudinal axis, presenting two larger side faces, two smaller flank faces and two end faces, are overwrapped by a unit incorporating a first conveyor rotatable about a relative axis, on which a sheet of transparent film is folded initially around the side and flank faces of each packet by one of a set of peripheral holder mechanisms pivotable about respective axes parallel to the axis of the conveyor. Each holder mechanism supports a relative packet, gripped between a pair of jaws and disposed with the longitudinal axis parallel to the axis of the conveyor, and comprises a clip serving to grip and retain one end of the sheet, operating in conjunction with suction holes by which the remaining free end of the sheet is attracted and restrained and thus kept perfectly under control during the transfer of the packet to a second conveyor that will complete the initial overwrapping step.

17 Claims, 4 Drawing Sheets

UNIT FOR OVERWRAPPING PRODUCTS, IN PARTICULAR PACKETS, AND A RELATIVE OVERWRAPPING METHOD

This application claims priority to Italian Patent Application No. BO2004A 000598, filed Sep. 27, 2004, which is incorporated by reference herein.

BACKGROUND OF THE INVENTION

The present invention relates to a unit for overwrapping products, packets in particular, and to a relative overwrapping method.

The invention finds application to advantage in the tobacco industry, where sheets of transparent material obtained from a continuous strip are used to overwrap packets of tobacco products, typically packets of cigarettes, to which reference is made explicitly in the following specification albeit implying no limitation in general scope.

More particularly, the present invention relates to a unit for overwrapping packets substantially of rectangular prismatic shape delimited axially by two end faces, and laterally by two larger faces and two smaller faces extending parallel to the longitudinal axis of the rectangular prism.

An overwrapping unit of the type in question comprises a feed device dispensing single wrapping sheets cut from a decoiling roll of continuous strip material, and the operation of overwrapping the packets is accomplished as the packets advance along a predetermined wrapping path, utilizing a plurality of folder mechanisms by which each packet is enveloped completely in a respective sheet.

Given the high output speeds of modern cigarette makers and packers, to which overwrapping units of the above noted type are linked, there is a growing need, if the overwrapped products are to emerge free of imperfections, for the single sheets of overwrapping material to be kept continuously and fully under control along the entire wrapping path and throughout the successive operations performed by the folder mechanisms, so as to avoid any possibility of a misalignment between the packet and the sheet, or a portion of the sheet, that could result in the finished overwrap presenting unsightly creases or blemishes.

Importantly, this need for complete control over the sheets is especially evident along stretches of the wrapping line that extend between areas where successive folder mechanisms operate, and more precisely along the stretches where, with the overwrap still not fully formed, one or more parts of the sheet still project freely and have yet to undergo the action of a fold-making element.

The object of the present invention is to provide a unit for overwrapping packets such as will meet the requirements indicated above, while operating at the high output speeds of which modern cigarette makers and packers are capable.

SUMMARY OF THE INVENTION

The stated object is realized according to the present invention in a unit for overwrapping packets of substantially rectangular prismatic shape presenting two larger side faces parallel one with another and with a longitudinal axis, two smaller flank faces disposed parallel to the longitudinal axis and normal to the larger faces, and two end faces normal to the longitudinal axis, comprising a first folding conveyor rotatable about a relative axis and performing the initial steps of an operation whereby a sheet of wrapping material is folded around the side and flank faces of the packet; a plurality of holder mechanisms mounted peripherally to the first folding conveyor, each pivotable about a respective axis parallel to the axis of rotation and serving to support respective single packets disposed with the longitudinal axis parallel to the selfsame axis; means associated with each of the holder mechanisms, by which to grip and retain a first end of the sheet; means associated with each of the holder mechanisms, by which to hold and restrain a second end of the sheet; and a second folding conveyor rotatable about an axis parallel to the axis of the first folding conveyor, by which the operation of wrapping the sheet around the four side and flank faces of the packet is completed.

The stated object is realized similarly in a method according to the present invention for overwrapping packets of substantially rectangular prismatic geometry, including the steps of feeding single packets to rotating holder mechanisms of a first folding wheel, in such a way that each packet is positioned with its longitudinal axis parallel to the axis of rotation of the first folding wheel; gripping each packet by two faces disposed transversely to the axis of rotation of the first folding wheel; feeding a sheet of wrapping material to each holder mechanism; pinning a first end of the sheet to the mechanism; effecting initial folding steps, by which the sheet is wrapped around the side and flank faces of the packet; holding and restraining a second free end of the sheet on the mechanism; and transferring the packet and the sheet to a second folding wheel.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
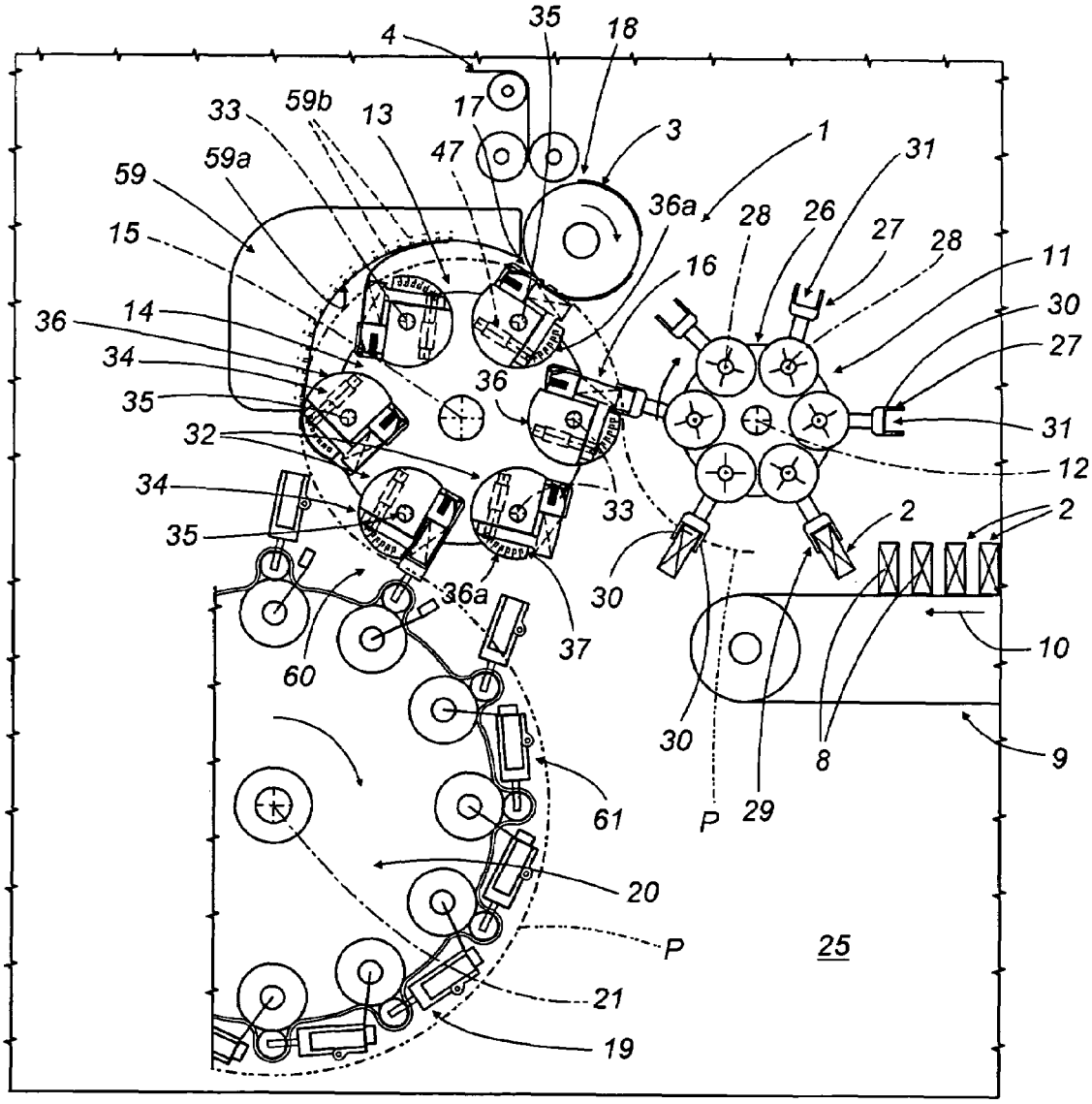
FIG. 1 shows an overwrapping unit embodied in accordance with the present invention, viewed schematically from the front with certain parts omitted and illustrated in a preferred embodiment.

With reference to FIG. 1, numeral 1 denotes a unit, in its entirety, for overwrapping packets 2 of cigarettes in sheets 3 of wrapping material that consist in discrete lengths cut from a continuous strip 4 of transparent film.

Figure 2:
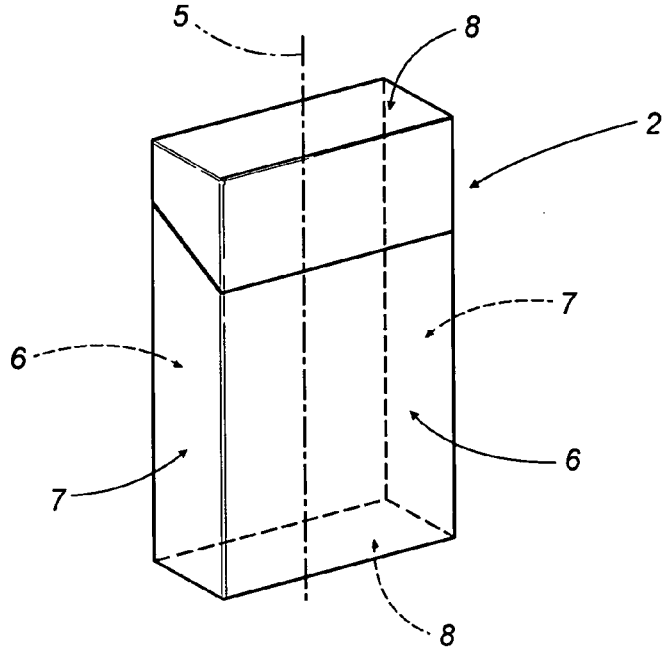
FIG. 2 shows a packet of cigarettes such as will be overwrapped by the unit of FIG. 1, viewed in perspective.

As illustrated in FIG. 2, each packet 2 appears as a rectangular prism referable to a longitudinal axis denoted 5, presenting two larger side faces 6 parallel one with another and with the longitudinal axis 5, two smaller side or flank faces 7 disposed parallel to the longitudinal axis 5 and at right angles to the larger faces 6, and two end faces 8 disposed transversely to the longitudinal axis 5.

The unit 1 comprises a substantially horizontal infeed conveyor 9 by which packets 2 are carried in ordered succession along a direction denoted 10, advancing on edge, that is to say with one flank face 7 resting on the infeed conveyor 9, and with the longitudinal axis 5 set transversely to the feed direction 10.

The unit 1 further comprises a transfer wheel 11 set in rotation clockwise (as viewed in FIG. 1) about a horizontal axis 12 transverse to the feed direction 10, by which the packets 2 are taken up in succession from the infeed conveyor 9, and a first folding conveyor 13 in the form of a wheel 14 rotatable counterclockwise about an axis 15 parallel to the axis 12 of the transfer wheel 11, by which the packets 2 are taken up in succession from the wheel 11 at a transfer station 16, and on which wrapping sheets 3 are taken up at a further station 17 from a feed unit 18 and bent each over a relative packet 2 to assume an "L" profile.

Also forming part of the unit 1 is a second folding conveyor 19, embodied as a second wheel 20 set in rotation clockwise about an axis 21 parallel to the axis 12 of the transfer wheel 11, onto which the packets 2 are taken up edgewise together with the relative sheets 3 folded to the "L" profile, and the sheets 3 thereupon bent further to form a tubular wrap enveloping each packet 2 and aligned on the relative longitudinal axis 5, employing a sequence of steps as described and illustrated in publication EP 1 260 442, to which reference may be made for a full description.

Proceeding beyond the second conveyor 19, the tubular wraps are closed and sealed in conventional manner and the overwrapped packets 2 are directed onto an outfeed conveyor (not illustrated) of the unit 1.

The infeed conveyor 9, the transfer wheel 11 and the first and second folding wheels 14 and 20 are mounted to a frame 25 of the unit 1, and combine to establish a wrapping path P that describes a substantially sinusoidal trajectory.

The transfer wheel 11, which turns substantially tangential to the infeed conveyor 9, comprises a power driven disc 26 centered on and rotatable about the axis 12 of the wheel 11, and, mounted to the disc 26, a plurality of gripping heads 27 spaced apart uniformly about the axis 12 and caused by a cam device of familiar type, not illustrated in the drawings, to pivot on respective axes 28 parallel to the selfsame axis 12. The gripping heads 27 are described in publication EP 1 260 442 mentioned above.

Each gripping head 27 comprises a respective gripper 29 projecting radially from the disc 26 and including two jaws 30 capable of movement one relative to another in a direction transverse to the radial direction, induced by actuator means of conventional embodiment (not illustrated), between an open condition and a closed condition.

When in the closed condition, the jaws 30 of the gripper 29 afford a slot 31 in which to accommodate a packet 2 disposed with one flank face 7 directed toward the axis 12 of the wheel 11 and the two larger side faces 6 in contact with the selfsame jaws 30.

In operation, with the transfer wheel 11 set in rotation, each packet 2 advancing along the infeed conveyor 9 will be picked up by a gripper 29 and then released to the first folding conveyor 13 at the transfer station 16, substantially as indicated in the aforementioned publication EP 1 260 442, to which reference can again be made for a complete description.

The first folding wheel 14 is equipped with a plurality of holder mechanisms 32 equispaced around the periphery, each pivotable about a respective axis 33 extending parallel to the axis 15 of the wheel 14 and serving to support a single packet 2.

Figure 3:
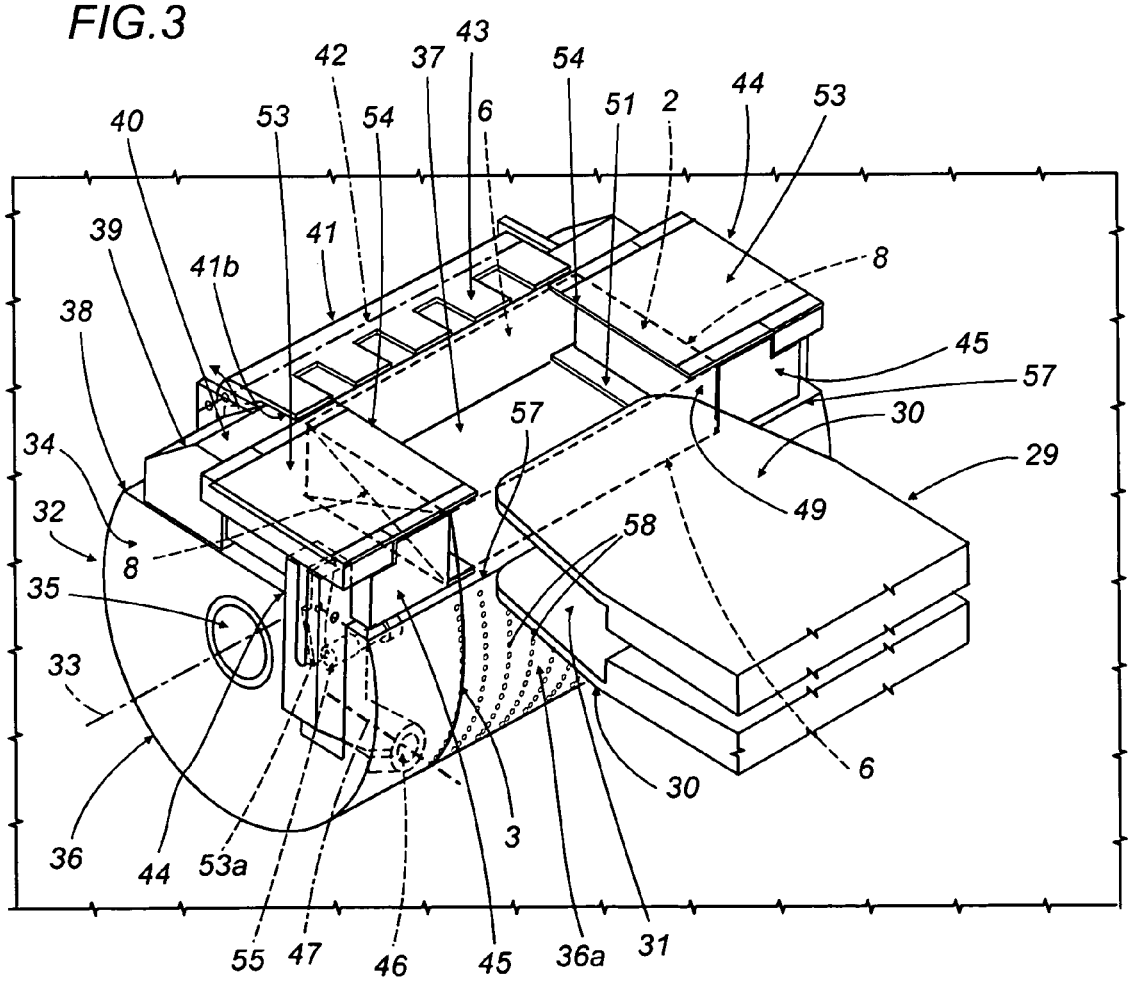
FIG. 3 shows a detail of FIG. 1, viewed schematically and in perspective.
Figure 4:
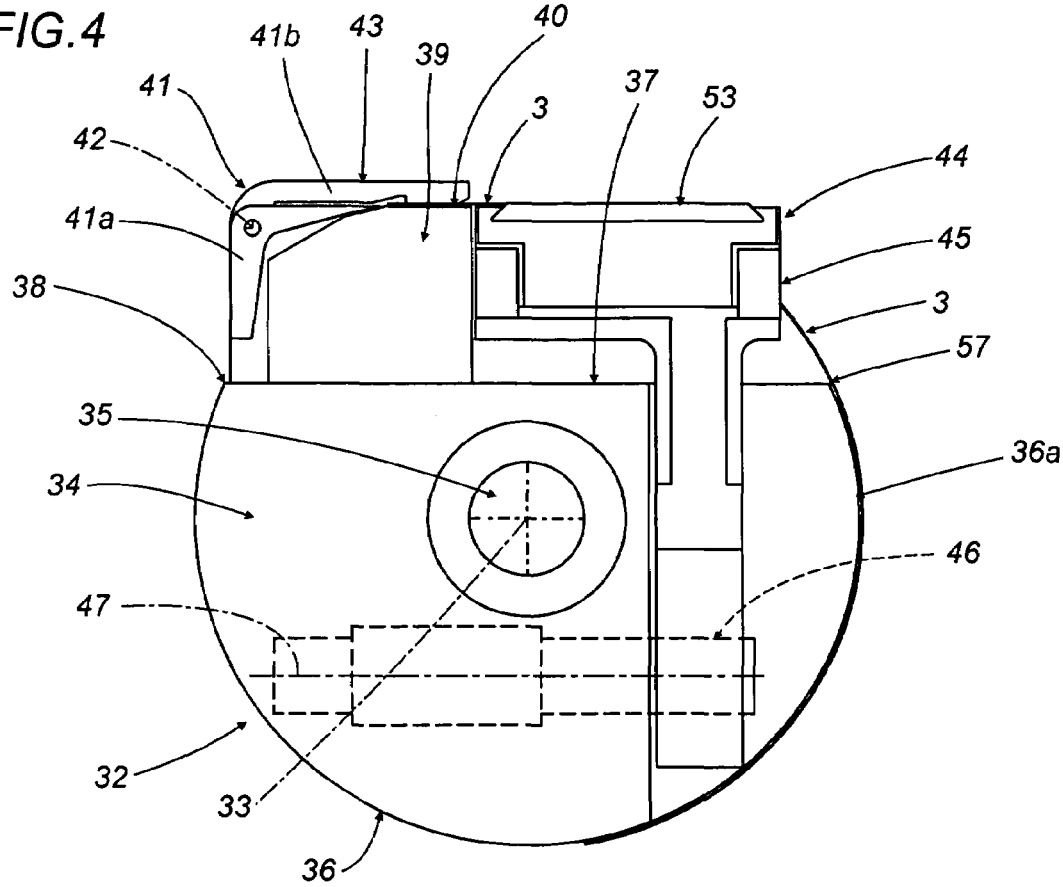
FIG. 4 shows a detail of FIG. 3, viewed schematically from the side.

As illustrated in FIGS. 3 and 4, each holder mechanism 32 comprises a first block 34 mounted to a shaft 35 centered on the axis 33 aforementioned, delimited in a direction parallel to the axis 33 by a cylindrical surface 36 and a flat face 37.

Mounted to the flat face 37 of the aforementioned first block 34, near to one longitudinal edge 38, is a substantially parallelepiped second block 39 of which one face 40, parallel to the flat face 37, functions as a fixed jaw interacting with means 41 pivotable about an axis 42 parallel to the axis 33 of the mechanism and serving to grip and retain a first end of the sheet 3.

Figure 7:
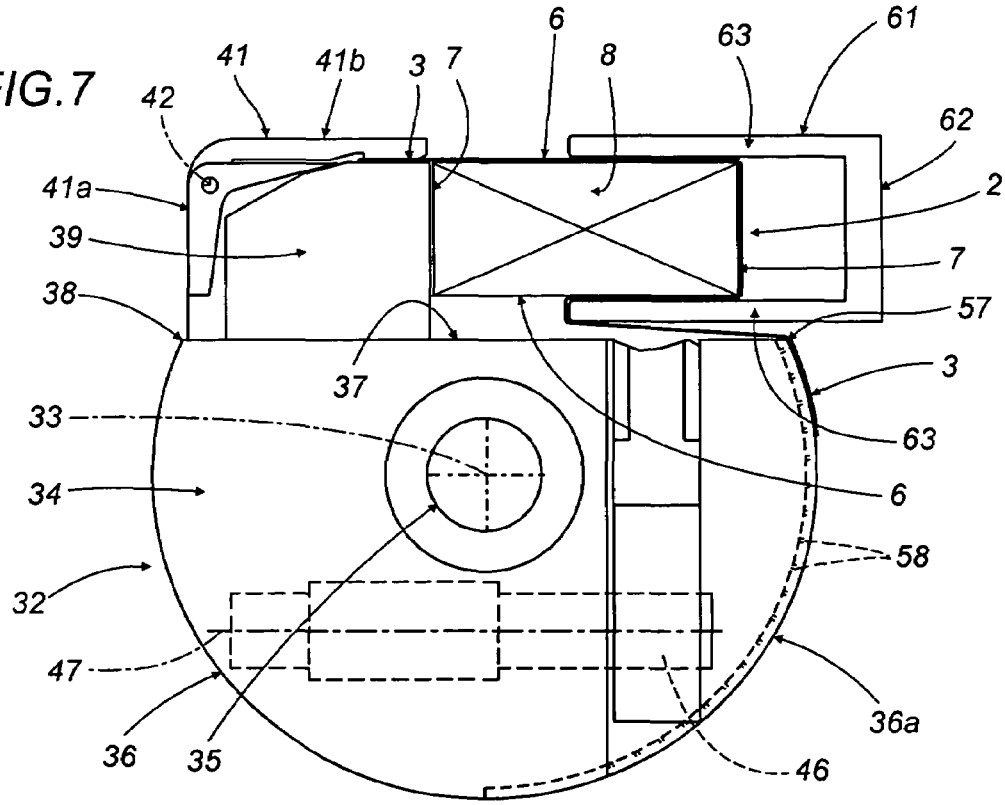
FIG. 7 shows the detail of FIG. 4, viewed schematically from the side and illustrated in a further operating position.

The gripping and retaining means 41 appear as a lever with two arms denoted 41*a* and 41*b*, presenting a plurality of fingers 43 and capable of movement between a position of disengagement from the fixed face 40 and a position substantially of contact with the selfsame face (see FIGS. 1, 4 and 7).

Movement of the gripping and retaining means 41 between the aforementioned positions is induced by respective actuator means of conventional type, not illustrated, acting on the arm denoted 41*a*.

As illustrated in FIGS. 3 to 7, each holder mechanism 32 comprises respective means by which to grip and support the packet 2, denoted 44 in their entirety and comprising a pair of jaws 45 mounted to respective shafts 46 pivotable about axes 47 extending transversely to the axis 33 of the mechanism and parallel to the flat face 37 of the first block 34.

Figure 5:
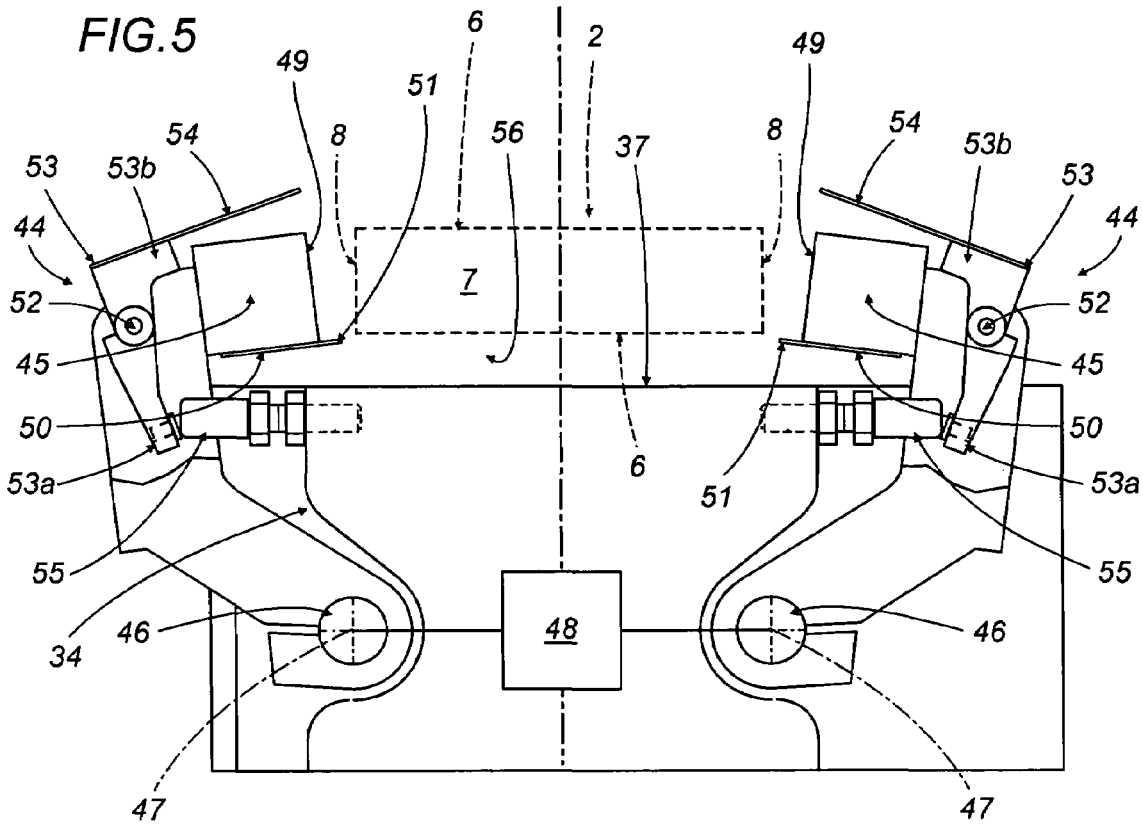
FIGS. 5 and 6 show the detail of FIG. 4, viewed schematically from the front and illustrated in two different operating positions.
Figure 6:
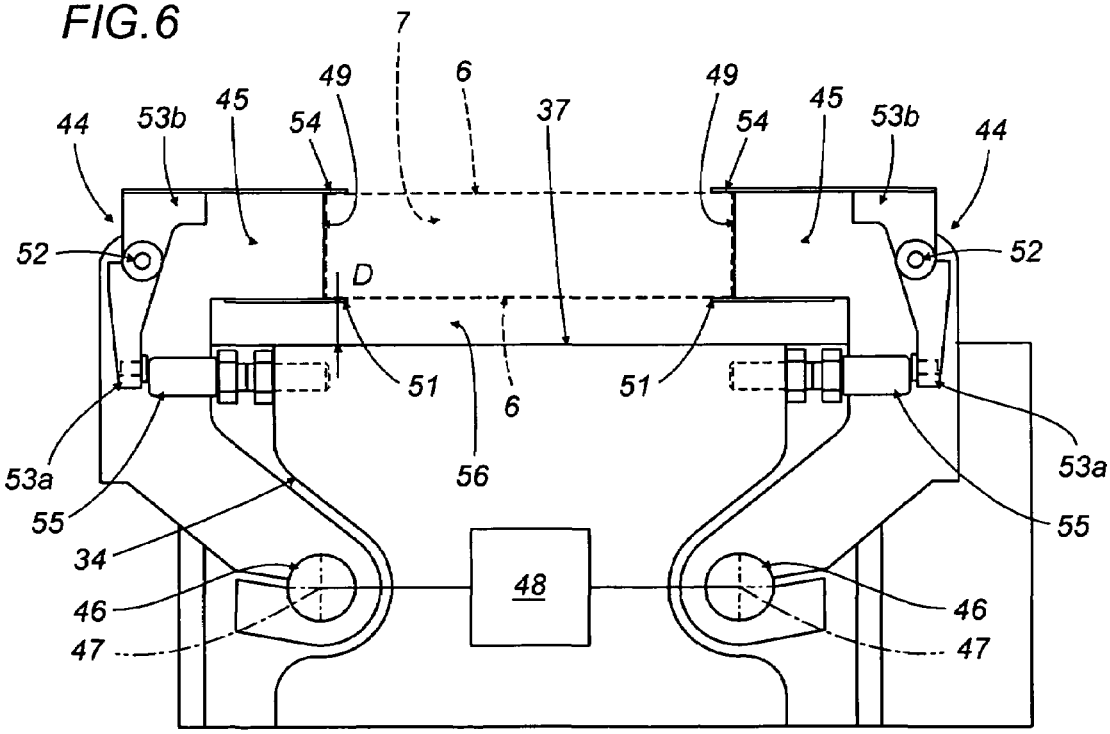

Referring to FIGS. 5 and 6, the jaws 45 are capable of movement, induced by respective actuator means of familiar type (not illustrated in detail) associated with each mechanism 32 and indicated schematically by a block denoted 48, between a first open position (FIG. 5), and a second closed position (FIG. 6) in which their substantially quadrangular contact ends 49 are placed at opposite ends of the aforementioned flat face 37, separated longitudinally by a distance marginally less than the longitudinal dimension of the packet 2.

Associated rigidly with a face 50 of each contact end 49 directed toward the first block 34, is a first plate 51 projecting toward the opposite contact end 49 and designed, when the jaws 45 are closed, to engage the side face 6 of the packet 2 directed toward the flat face 37 of the block 34.

Each jaw 45 carries a fulcrum pivot 52 extending parallel to the aforementioned axis 47, and a clamp element 53 mounted at an intermediate point to the pivot 52, consisting in a lever with two arms 53*a* and 53*b* of which the latter arm 53*b* presents a second plate 54 at the free end, combining with the first plate 51 to pinch and restrain the packet 2.

In particular, during the closing movement of the gripping and supporting means 44, the free end of the arm denoted 53*a* is engaged and checked by a fixed stop 55 that induces an angular movement of the clamp element 53 about the pivot 52 against the action of a coil spring (of conventional type, not illustrated) wound around the pivot 52, between a position of disengagement illustrated in FIG. 5, and a position in which the second plate 54 engages the remaining side face 6 of the packet 2, thereby combining with the corresponding first plate 51 to grip the packet 2, as illustrated in FIG. 6.

It will be seen moreover that the first plate 51 is separated from the flat face 37 by a given distance D in such a way as to create a void 56, for reasons of access that will become apparent in due course.

It will be seen also, in FIGS. 3 to 7, that the aforementioned cylindrical surface 36 of the first block 34 presents a portion 36*a*, extending from a longitudinal edge 57 opposite to the aforementioned longitudinal edge 38, furnished with a plurality of suction holes 58 connected to a source of negative pressure not illustrated in the drawings.

The aforementioned portion 36*a* of the cylindrical surface 36 combines with the suction holes 58 to provide means by which a second end of the sheet 3 is held and restrained.

In operation, with the transfer wheel 11 and the first folding wheel 14 set in rotation about their respective axes 12 and 15, each single packet 2 is released by a gripping head 27 to a corresponding holder mechanism 32 at the transfer station 16, as the jaws 30 of the gripper 29 are distanced from the larger faces 6 and the jaws 45 of the gripping and supporting means 44 simultaneously close on the two end faces 8 of the packet 2.

As the packet advances to the next station 17, a sheet 3 of film is supplied by the feed unit 18 to the relative holder mechanism 32, and pinned at the first end by the gripping and retaining means 41.

As the folding wheel 14 rotates on its axis 15 and the holder mechanism 32 is caused at the same time to pivot on its own axis 33 by actuator means of conventional type (not illustrated), the sheet 3 encounters a fixed restraint 59 of curved profile, substantially concentric with the wheel 14 and presenting an internal surface 59*a* with suction holes 59*b* connected to a source of negative pressure (not indicated), by which it is drawn flat progressively against the larger side face 6 of the packet 2 located farther from the flat face 37 of the block 34 and then bent over the adjoining flank face 7 to assume an "L" profile.

The restraint 59, the relative surface 59*a* and the suction holes 59*b* combine to establish fixed folder means.

At the point of exit from the fixed restraint 59, the second part of the sheet 3 is attracted to the aforementioned portion 36*a* presented by the cylindrical surface 36 of the first block 34, and held by suction generated through the holes 58.

As the folding wheel 14 continues to rotate, the holder mechanism 32 in question advances beyond the point of exit from the restraint 59 and into a station 60 at which the packet 2 is transferred to the second folding wheel 20, which is equipped with a plurality of pivoting U-shaped pockets 61 each presenting a back wall 62 and two side members 63.

As it passes through the transfer station 60, the packet 2 is directed gradually from the holder mechanism 32 into the pocket 61. During the course of the transfer, as discernible in FIGS. 1 to 7, one of the two side members 63 will penetrate gradually into the aforementioned void 56 and thus smooth the sheet 3, still pinned at one end by the gripping and retaining means 41, against the larger side face 6 of the packet 2 directed toward the flat face 37 of the first block 34.

To advantage, the holding and restraining means afforded by the holes 58 generate an aspirating action on the trailing part of the sheet 3 such as will attract the selfsame sheet and ensure that it remains perfectly under control when smoothed by the side member 63 of the pocket 61 against the relative side face 6 of the packet 2, and when sliding over the aspirating portion 36*a* of the cylindrical surface 36.

The step that takes place on the second folding wheel 20, in familiar manner, is that of completing and securing the tubular wrap around the packet 2.

What is claimed is:

1. A unit for overwrapping packets of substantially rectangular prismatic shape presenting two larger side faces parallel one with another and with a longitudinal axis, two smaller flank faces disposed parallel to the longitudinal axis and normal to the larger faces, and two end faces normal to the longitudinal axis, comprising:

a first folding conveyor rotatable about a relative axis and performing the initial steps of an operation whereby a sheet of wrapping material is folded around the two side and two flank faces of the packet;

a plurality of holder mechanisms mounted peripherally on the first folding conveyor, each pivotable about a respective axis parallel to the axis of rotation and serving to support respective single packets disposed with the longitudinal axis parallel to the selfsame axis;

each of the holder mechanisms comprising means for gripping and retaining a first end of the sheet;

each of the holder mechanisms comprising means for holding and restraining a second end of the sheet;

a second folding conveyor rotatable about an axis parallel to the axis of the first folding conveyor, by which the operation of wrapping the sheet around the two side and two flank faces of the packet is completed.

2. A unit for overwrapping packets as in claim 1, comprising fixed folder means combining with the holder mechanisms to perform the initial folding steps.

3. A unit for overwrapping packets as in claim 2, wherein the second end of the sheet is held and restrained by means operating at least along a stretch of the path described by the first folding conveyor that extends between a point of exit from the fixed folder means and a transfer station interconnecting the first folding conveyor and the second folding conveyor.

4. A unit for overwrapping packets as in claim 3, wherein the holding and restraining means comprises suction means.

5. A unit for overwrapping packets as in claim 4, wherein the holder mechanism comprises a block mounted to a shaft rotatable about a relative axis, delimited at least in part by a substantially cylindrical surface presenting a respective portion furnished with suction holes.

6. A unit for overwrapplng packets as in claim 5, wherein the packet is gripped and supported on the holder mechanism in a position interposed between the means sewing to grip and retain a first end of the sheet and the means serving to hold and restrain a second end of the sheet, through the action of means comprising a pair of jaws designed to engage the two end faces of the packet, which lie transverse to the axis of rotation of the holder mechanism.

7. A unit for overwrapping packets as in claim 6, wherein the gripping and supporting means comprise a pair of plates associated with each jaw and positioned to engage the two larger side faces of the packet.

8. A unit for overwrapping packets as in claim 2, wherein the holding and restraining means comprises suction means.

9. A unit for overwrapping packets as in claim 8, wherein the holder mechanism comprises a block mounted to a shaft rotatable about a relative axis, delimited at least in part by a substantially cylindrical surface presenting a respective portion furnished with suction holes.

10. A unit for overwrapping packets as in claim 1, wherein the holding and restraining means comprises suction means.

11. A unit for overwrapping packets as in claim 10, wherein the holder mechanism comprises a block mounted to a shaft rotatable about a relative axis, delimited at least in part by a substantially cylindrical surface presenting a respective portion furnished with suction holes.

12. A unit for overwrapping packets as in claim 11, wherein the packet is gripped and supported on the holder mechanism in a position interposed between the means serving to grip and retain a first end of the sheet and the means serving to hold and restrain a second end of the sheet, through the action of means comprising a pair of jaws designed to engage the two end faces of the packet, which lie transverse to the axis of rotation of the mechanism.

13. A unit for overwrapping packets as in claim 12, wherein the gripping and supporting means comprise a pair of plates associated with each jaw and positioned to engage the two larger side laces of the packet.

14. A unit for ovenwrapping packets as in claim 1, wherein the packet is gripped and supported on the holder mechanism in a position interposed between the means serving to grip and retain a first end of the sheet and the means serving to hold and restrain a second end of the sheet, through the action of means comprising a pair of jaws designed to engage the two end faces of the packet, which lie transverse to the axis of rotation of the mechanism.

15. A unit for overwrapping packets as in claim 14, wherein the gripping and supporting means comprise a pair of plates associated with each jaw and positioned to engage the two larger side faces of the packet.

16. A method of overwrapping packets of substantially rectangular prismatic shape presenting two larger side faces parallel one with another and with a longitudinal axis, two smaller flank faces disposed parallel to the longitudinal axis and normal to the larger faces, and two end faces normal to the longitudinal axis, including the steps of:

feeding single packets to rotating holder mechanisms of a first folding wheel, in such a way that each packet is positioned with its longitudinal axis parallel to the axis of rotation of the first folding wheel;

gripping each packet by two faces disposed transversely to the axis of rotation of the first folding wheel;

feeding a sheet of wrapping material to each holder mechanism;

gripping and holding a first end of the sheet with the holder mechanism;

effecting initial folding steps, by which the sheet is wrapped around the two side and two flank faces of the packet;

holding and restraining a second free end of the sheet with the holder mechanism;

transferring the packet and the sheet to a second folding wheel.

17. A method as in claim 16, wherein after the step of gripping the packet by two faces disposed transversely to the axis of rotation of the first folding wheel, further comprising a step of gripping opposite end portions of the two larger side faces presented by the packet.

* * * * *